US005612658A

United States Patent [19]

Hendel et al.

[11] Patent Number: 5,612,658

[45] Date of Patent: Mar. 18, 1997

[54] ELECTROMAGNETIC RELAY

[75] Inventors: Horst Hendel; Bernhard Kleine-Onnebrink, both of Berlin, Germany

[73] Assignee: Siemens Aktiengesellschaft, Munich, Germany

[21] Appl. No.: 356,292

[22] PCT Filed: Jun. 1, 1993

[86] PCT No.: PCT/DE93/00470

§ 371 Date: Aug. 2, 1995

§ 102(e) Date: Aug. 2, 1995

[87] PCT Pub. No.: WO93/26030

PCT Pub. Date: Dec. 23, 1993

[30] Foreign Application Priority Data

Jun. 17, 1992 [DE] Germany ..... 42 19 933.6

[51] Int. Cl.[6] ..... H01H 51/22

[52] U.S. Cl. ..... 335/78; 335/159; 335/128

[58] Field of Search ..... 335/78–86, 88, 335/124, 128, 131–3, 159–61

[56] References Cited

U.S. PATENT DOCUMENTS 4,482,875 11/1984 Peterseil .
4,529,953 7/1985 Myers .
4,816,794 3/1989 Nagao .
4,959,627 9/1990 Iizumi et al. ..... 335/128
5,382,934 1/1995 Hendel et al. ..... 335/78
5,394,127 2/1995 Hendel et al. ..... 335/78

FOREIGN PATENT DOCUMENTS 1036914 8/1958 Germany .
3124412 12/1982 Germany .
3834283 4/1990 Germany .

*Primary Examiner*—Lincoln Donovan

[57] ABSTRACT

In the relay, a holding pin for a contact spring is arranged in each case in the region between the armature and the coil in such a way that the load current that flows via the contact spring can flow through the ferromagnetic circuit of the coil, comprising the core, the yoke (12) and the armature (13). In order to avoid negative effects of such a current loop, a connecting pin (110) is anchored in a base body outside the ferromagnetic circuit, on that side of the armature opposite to the contact spring (7), which connecting pin conducts the load current of the contact spring via a hoop portion (111) that engages over the armature. Optionally, the holding pin (9) of the contact spring may also be additionally contacted with a part of the load current, in order to make use of certain effects of the current loop.

6 Claims, 3 Drawing Sheets

ELECTROMAGNETIC RELAY

BACKGROUND OF THE INVENTION

The invention relates to an electromagnetic relay, which exhibits the following features:

an insulating base body, at least one coil, disposed on the base body, with a winding and a core, a yoke connected to a first end of the core, an armature which is mounted on the yoke and which forms an air gap with the second end of the core, at least one contact spring, which is disposed between armature and coil and which is pivotably secured, in the vicinity of the armature bearing position, to a holding pin anchored in the base body and can be switched over, by its free end, by the armature between a neutral position and a working position, and at least one countercontact element, which is anchored in the base body and which, in a specified switching position of the armature, closes a load current circuit with the contact spring, the holding pin being situated within the ferromagnetic circuit formed by the yoke, the armature and the core and the countercontact element being situated, at least by a connecting portion, outside this ferromagnetic circuit.

With the arrangement, provided in this construction, of the contact spring between armature and coil, it is possible to create a compact relay construction; in this case, the contact spring is actuatable in a simple manner directly by the armature when the latter is attracted to the core. This arrangement of the contact spring is particularly advantageous in the construction of a switchover relay, forming the subject of the older, non-prior-published European Patent Application No. 91111423.9. In that case, two separately drivable coils with in each case one winding and in each case one core are aligned substantially axially in relation to one another on the base body; in this case, an air gap is formed between the mutually facing inner core ends and the outer core ends are connected to a yoke. By means of an armature mounted at a center region of the yoke, contact springs disposed in that case in each instance between the armature and the coil can be switched over by the armature optionally between a neutral position and a working position; in this case, at least two stationary countercontact elements anchored in the base body provide contact in each instance at least with one contact spring in at least one of their switching positions.

The arrangement, provided here, of a holding pin for a contact spring in the region between armature and coil can influence the function of the relay insofar as via the contact spring with a bearing pin serving as a connecting pin and the countercontact element when the contact is closed, a current loop conducted through the ferromagnetic circuit of the core, the yoke and the armature can be formed, the magnetic field of which is superposed upon the exciter circuit of the coil. Depending upon the direction of flow in this current loop, the additionally generated magnetic flux can be directed in the same direction as the exciter flux or in the opposite direction thereto and can thus intensify or weaken the attractive force on the armature. A problem can however arise where a very high load current flows via a closing contact when the armature has been attracted and this load current, by means of its magnetic field, holds the armature fast, in the attracted condition, even after deenergization of the excitation, so that the armature cannot fall away any longer. As long as only a simple relay with one contact spring and one connecting pin between the armature and the coil is involved, such a condition can be eliminated by appropriate polarity of the load current connections. However, in the case of a switchover relay with two series-connected coils, an intermediate armature and with contact springs on each side of the armature, such a compensation can be carried out only in one direction, so that the mentioned problem can arise in the case of extremely high contact currents.

SUMMARY OF THE INVENTION

Accordingly, an object of the present invention is, by constructional refinement of a relay construction of the initially mentioned type, to create the possibility that the loop effect of the holding pin disposed between the armature, the yoke and the core can be eliminated at least for specified applications involving high contact currents.

According to the invention, this and other objects and advantages are achieved in that a connecting pin for the contact spring is anchored in the base body on that side of the armature or of the yoke which is opposite to the contact spring and is conductively connected to the contact spring via a hoop portion which engages over the armature or the yoke. By this measure according to the invention, the possibility is thus created of not using the holding pin of the pertinent contact spring as the current connection, but of feeding the contact current beyond the armature or the yoke via the hoop portion of the contact spring, so that no closed current loop passes through the ferromagnetic circuit of the magnet system.

For the initially mentioned preferred practical application of a switchover relay with two magnet systems and an intermediate armature, the solution according to the invention of the described problem is achieved in that the connecting pins of both the contact springs are anchored in the region between the armature and the one coil in the base body; in this case, the one connecting pin serves as the holding pin for the one contact spring and the other is connected to the other contact spring through a hoop portion engaging over the armature. Accordingly, this other contact spring possesses a holding pin which does not serve as the connecting pin or at least need not be used as such.

In an advantageous refinement, it is however possible, in this case also, to design the holding pin of the other contact spring likewise as the connecting pin. Thus, this further connecting pin can also be utilized, in place of the opposite connecting pin or additionally to the latter, for conducting the load current. Thus, for practical applications in which the loop effect is desired, in the case of both contact springs in each instance their holding pin can also be used as connecting pin. If, on the other hand, it is desired that the loop effect should be applicable only partially, then the holding pin of this other contact spring can be connected in parallel with the separate connecting pin connected to it, so that half of the load current flows through pin. The loop effect then likewise amounts to only approximately half of the loop current effect on passing the full load current via the pertinent bearing pin.

In a preferred refinement, a U-shaped connecting hoop is secured, engaging over the armature, by both ends in the base body, a first limb forming the connecting pin and a second limb forming a holding pin for the contact spring connected to the connecting pin. Expediently, this U-shaped connecting hoop is secured in the base body in plug-in fashion, while the separate connecting and holding pin of the former contact spring can be embedded in the base body.

BRIEF DESCRIPTION OF THE DRAWINGS

The invention is explained in greater detail hereinbelow with reference to embodiments, referring to the drawing. In the drawing.

DETAILED DESCRIPTION OF THE PREFERRED EMBODIMENTS

Figure 1:
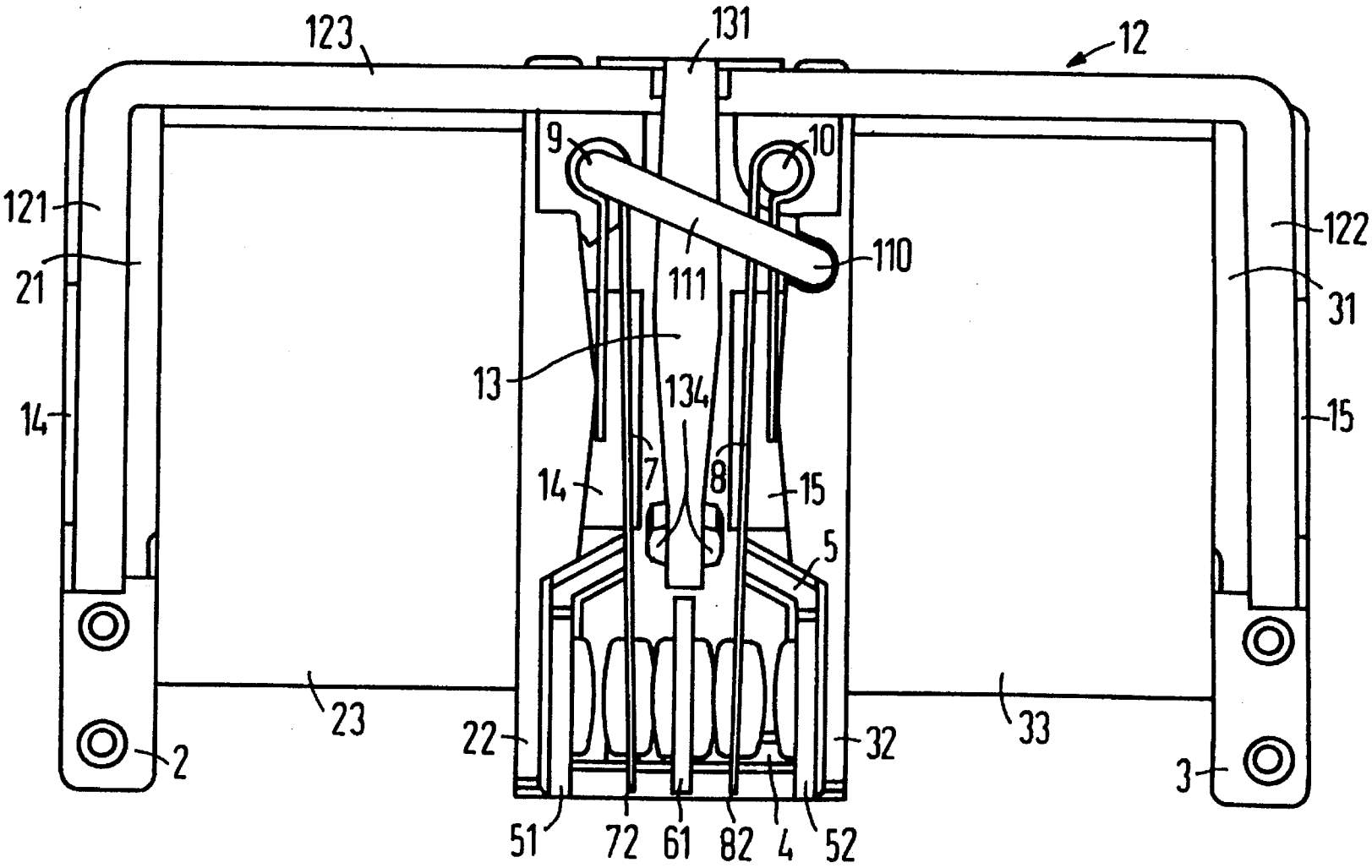
FIG. 1 shows an electromagnetic switchover relay with two coils and an intermediate armature, in plan view.
Figure 2:
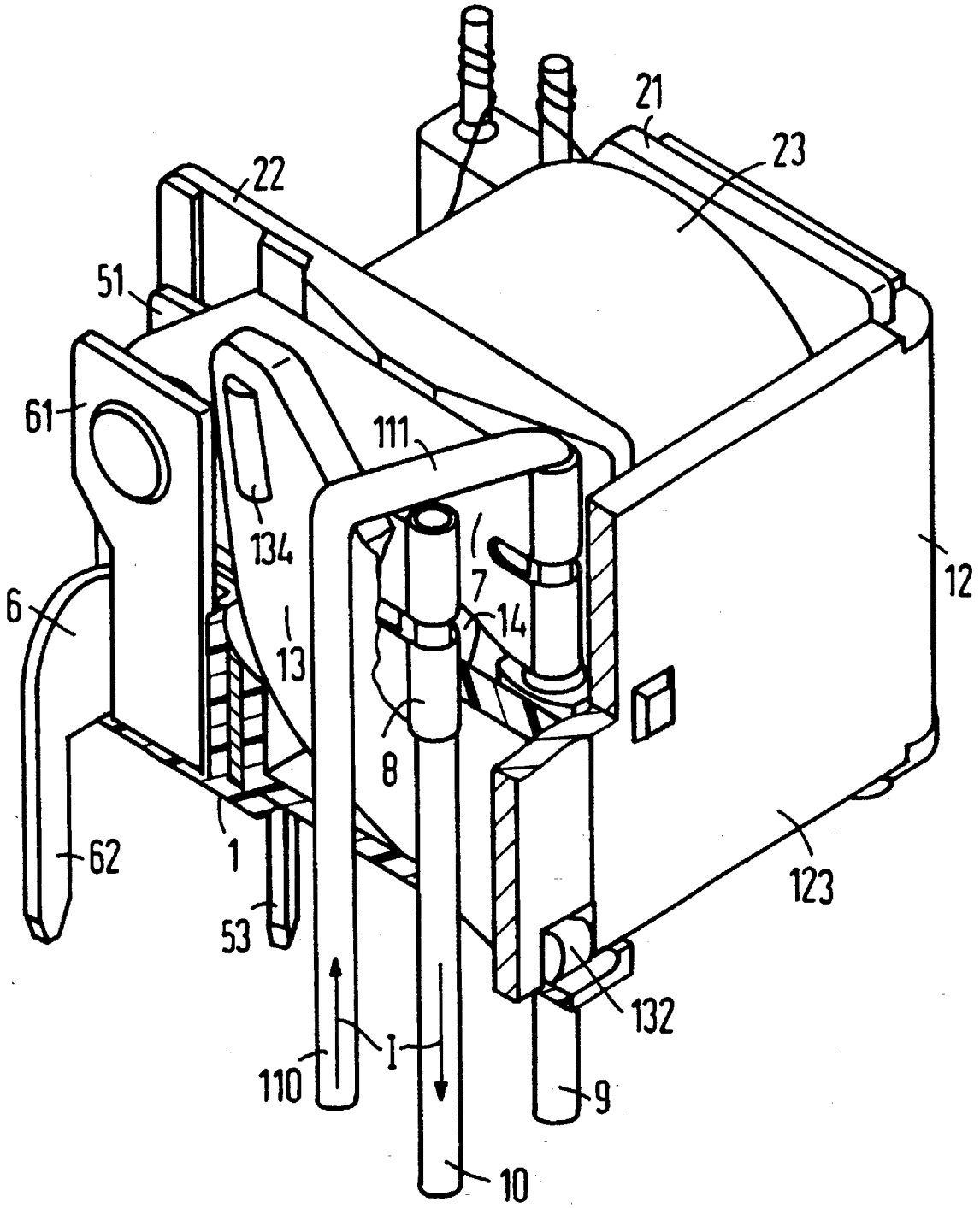
FIG. 2 shows a perspective view of a relay according to FIG. 1, sectioned approximately at the center in the region of the armature.

The relay shown in FIGS. 1 and 2 possesses a base body 1, which exhibits two integrally connected coil formers 2 and 3 as well as a contact space 4 formed between the two coil formers. On the coil former 2 a winding 23 is applied between two flanges 21 and 22; on the coil former 3, a winding 33 is applied between flanges 31 and 32. Via separate winding connections, the two coils can be individually driven and excited.

In the contact chamber 4, a U-shaped contact sheet 5 is secured by plugging in, which contact sheet forms in one piece two outer contact elements 51 and 52 and is passed with a connecting pin 53 through the floor of the base body. A further contact sheet 6 forms a center contact element 61 and a connecting pin 62 passed through the floor of the base body. The outer contact elements 51 and 52 are in each instance provided with a contact piece, and the center contact element 61 with two contact pieces. Furthermore, in the contact chamber 4 there are disposed two contact springs 7 and 8, which comprise leaf spring material. Each contact spring is bent at a securing end into a clamping sleeve and is fitted by the latter onto a connecting and holding pin 9 and 10 respectively. Opposite to the securing ends, the contact springs form in each instance contact-providing ends 72 and 82 respectively, which are provided in each instance on both sides with contact pieces and can be switched over between the center contact element 61 and in each case one countercontact element 51 and 52 respectively.

The contact springs 7 and 8 are in each instance prestressed toward the center contact element 61. In their central part, the contact springs possess in each instance a cutout (not visible), which is adapted to the rounding of the associated coil core and permits a free movement of the contact spring above the coil core.

A yoke-armature assembly is fitted onto the coil former provided with windings and contact elements. This assembly comprises a yoke 12 with two side portions 121 and 122 as well as an elongate center portion 123. This yoke is fitted onto the coil flanges 21 and 31. On the center portion 123 of the yoke there is moreover mounted an armature 13, which is held by holding tongues 131 and 132 in corresponding bearing notches of the yoke.

Switching cams 134 are integrally shaped on the armature 13, on both sides, which cams serve to actuate the contact springs 7 and 8. The function is thus recognizable from the constructional design. In the neutral condition, both contact springs 7 and 8 rest by their contact-providing ends on the center contact element 61. Depending upon the respective excitation of one winding 23 or 33, the armature is attracted to an associated core 14 or 15, in which case it brings the associated contact spring 7 or 8 into contact with the corresponding outer contact element 51 or 52. In this case, the respective other contact spring remains resting on the center contact element 61 or respectively returns to the latter.

If now the two holding pins 9 and 10 are in each instance also used as connecting pins for the two contact springs, in such a manner that the contact current flows via the one or the other holding pin, then at very high contact currents as a result of the current loop, formed in this way, in the ferromagnetic circuit of the core, the yoke and the armature, such a strong additional magnetic field can be generated that in certain circumstances the armature no longer falls away into the pertinent circuit, even after deenergization of the excitation. For this reason, an additional connecting pin 110 is provided in the region between the armature 13 and the coil winding 33, which pin, via a hoop portion 111, engages over the armature and is connected to the holding pin 9 of the contact spring 7. In the case of the construction shown, the connecting pin 110 forms, with the hoop portion 111 and the holding pin 9, a U-shaped connecting hoop, which is secured in the base body by plugging in. However, it would also be feasible to secure a connecting pin 110 and a holding pin 9, just like the holding and connecting pin 10, in the base body by embedding and to bend a hoop portion 111 over the armature and to weld or otherwise to secure the same to the respective opposite part.

In the case of this arrangement of the two connections in the region of the one coil, a compensation of the load loop effect takes place on this side, while the magnetic circuit of the other coil is in any case free from a load loop.

In the case of a use of the relay as a polarity-reversing relay, the contact current I flows in each instance in the two contact springs and in their connecting pins in opposite directions. Since now the two connecting pins 10 and 110 lie on one side of the armature in the ferromagnetic circuit of the winding 33, their respective current loop effect substantially cancels out, while no current loop effect arises in the ferromagnetic circuit of the winding 23, as long as the holding pin 9 does not carry the contact current. If however a current loop effect is to be generated in a controlled fashion, then the holding pin 9 can also be used as the connecting pin in place of the pin 110. In particular, it is feasible to connect the two connecting pins 9 and 110 in parallel outside the relay, and thus to carry a respective half of the contact current via each one of the pins. This current division achieves a loop effect of approximately 50% as compared with the full loop effect; this can be of advantage in specified load cases, e.g. with a lamp load.

Figure 3:
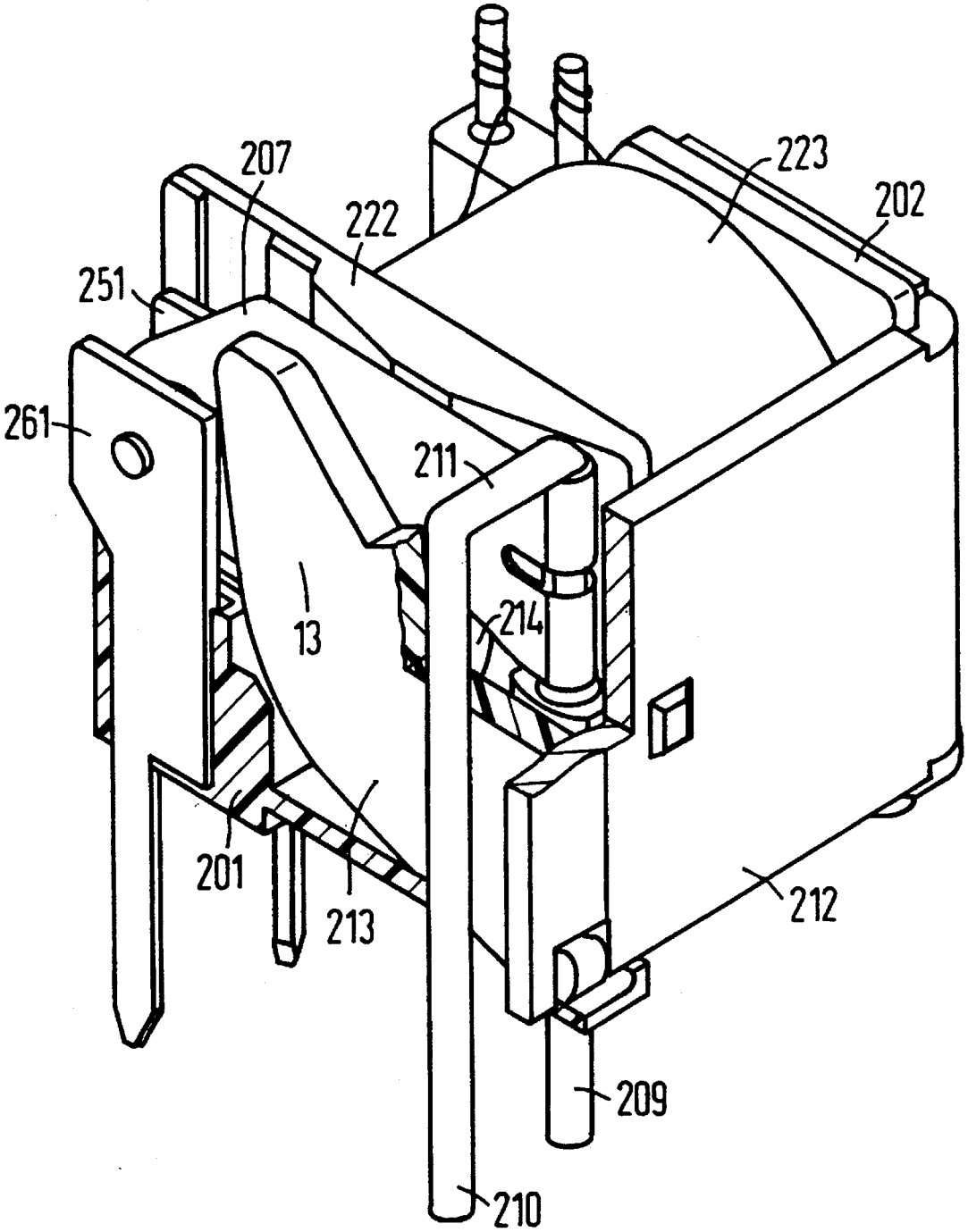
FIG. 3 shows a perspective view of an individual relay designed according to the invention, with only one coil and one armature.

FIG. 3 shows, in a slight modification as compared with FIG. 2, an individual relay in which likewise a holding pin is disposed between the armature and the now single coil, but the current loop effect is eliminated. In this construction, a base body 201 carries a coil former 202 with a winding 223, a core 214 and a yoke 212. An armature 213 is mounted on the yoke 212 in a similar manner to the embodiment of FIG. 2. Moreover, a contact spring 207 is secured between the armature 213 and a coil flange 222. This contact spring 207 is capable of being switched over between two countercontact elements 251 and 261. The entire construction is similar to that of the previously described relay, apart from the fact that the second coil system is absent and accordingly the base body and the yoke are only approximately half as large as in the preceding case and the remaining parts are correspondingly adapted.

In order to be able to eliminate the current loop effect in this case as well, the contact spring 7 is indeed secured on a holding pin 209, but the current supply takes place via a connecting pin 210, which is conductively connected to the contact spring via a hoop portion 211. In the embodiment, moreover, the connecting pin 210 is designed integrally with the hoop portion 211 and the holding pin 209 as a wire element bent in a U-shape, which is secured in the base body 201 by plugging in. In this case also, it is, as previously described, possible to eliminate entirely [lacuna] by appropriate conduction of the load current only via the connecting pin 210 or also to use this current loop effect in whole or in part by additional connection of the holding pin 209.

Although other modifications and changes may be suggested by those skilled in the art, it is the intention of the inventors to embody within the patent warranted hereon all changes and modifications as reasonably and properly come within the scope of their contribution to the art.

We claim:

1. An electromagnetic relay, comprising:

an insulating base body, at least one coil disposed on said insulating base body, with a core, a yoke connected to a first end of said core, an armature mounted on said yoke at an armature bearing position and defining an air gap between a second end of said core, a holding pin anchored in said insulating base body;

at least one contact spring disposed between said armature and said coil and which is secured adjacent said armature bearing position, to said holding pin said at least one contact spring having a free end that is switchable by said armature between a neutral position and a working position, at least one countercontact element anchored in said insulating base body and which, in a specified switching position of said armature, closes a load current circuit with said at least one contact spring, said holding pin being situated within a ferromagnetic circuit formed by said yoke, said armature and said core and said countercontact element being situated, at least by a connecting portion, outside said ferromagnetic circuit, a connecting pin for said at least one contact spring being anchored in said insulating base body on that side of said armature opposite to said contact spring and said connecting pin being conductively connected to said at least one contact spring via a hoop portion which engages over said armature.

2. An electromagnetic relay as claimed in claim 1, wherein:

said at least one coil comprises two separately drivable coils disposed on said insulating base body with in each case one winding and in each case one core which are aligned substantially axially in relation to one another, an air gap being formed between mutually facing inner ends of said cores;

said yoke connecting outer ends of said cores to one another, said armature being mounted on a center region of said yoke and disposed in the air gap between said mutually facing inner ends of said cores, said at least one contact spring being at least two contact springs disposed in each case between said armature and said coils and secured adjacent said armature bearing position, said at least two contact springs being switchable over by free, contact-providing ends in each instance by said armature between a neutral position and working position, and said at least one stationary countercontact element being at least two stationary countercontact elements anchored in said insulating base body and which provide contact in each instance at least with one contact spring of said at least two contact springs in at least one of their switching positions, said connecting pin comprising two connecting pins of corresponding ones of said at least two contact springs anchored in said insulating base body between said armature and one of said coils, one of said two connecting pins serving as said holding pin for said one contact spring and a second one of said connecting pins connected to the a second one of said at least two contact springs through a hoop portion engaging over said armature.

3. An electromagnetic relay as claimed in claim 1, wherein said holding pin of said at least one contact spring also being said connecting pin.

4. An electromagnetic relay as claimed in claim 1, further comprising:

a U-shaped connecting hoop secured over said armature by both ends being in said insulating base body, a first limb being said connecting pin and a second limb being said holding pin for said at least one contact spring.

5. An electromagnetic relay as claimed in claim 4, wherein said U-shaped connecting hoop is secured in said insulating base body in plug-in fashion.

6. A relay, comprising:

an insulating base body, at least one coil disposed on said insulating base body, with a core, a yoke connected to a first end of said core, an armature mounted on said yoke at an armature bearing position and defining an air gap between a second end of said core, a holding pin anchored in said insulating base body;

at least one contact spring disposed between said armature and said coil and which is secured adjacent said armature bearing position, to said holding pin said at least one contact spring having a free end that is switchable by said armature between a neutral position and a working position, at least one countercontact element anchored in said insulating base body and which, in a specified switching position of said armature, closes a load current circuit with said at least one contact spring, said holding pin being situated within a ferromagnetic circuit formed by said yoke, said armature and said core and said countercontact element being situated, at least by a connecting portion, outside said ferromagnetic circuit, a connecting pin for said at least one contact spring being anchored in said insulating base body on that side of said yoke opposite to said contact spring and said connecting pin being conductively connected to said at least one contact spring via a hoop portion which engages over said the yoke.

* * * * *